United States Patent [19]

Borel

[11] Patent Number: 4,649,074

[45] Date of Patent: Mar. 10, 1987

[54] PAPERMACHINE FABRIC IN THE FORM OF A SPIRAL LINK BELT COVERED WITH NONWOVEN FABRIC

[75] Inventor: Georg Borel, Reutlingen, Fed. Rep. of Germany

[73] Assignee: Hermann Wangner GmbH & Co., KG, Fed. Rep. of Germany

[21] Appl. No.: 891,032

[22] Filed: Jul. 31, 1986

[30] Foreign Application Priority Data

Aug. 7, 1985 [DE] Fed. Rep. of Germany ..... 3528363

[51] Int. Cl.[4] ..... D03D 13/00

[52] U.S. Cl. ..... 428/222; 28/104; 28/105; 428/224; 428/284; 428/299

[58] Field of Search ..... 428/221, 222, 223, 224, 428/299, 284; 28/104, 105

[56] References Cited

U.S. PATENT DOCUMENTS

| | | | |
|---|---|---|---|
| 4,346,138 | 8/1982 | Lefferts | 428/222 |
| 4,362,776 | 12/1982 | Lefferts et al. | 428/222 |
| 4,481,079 | 11/1984 | Dawes | 428/222 |
| 4,528,236 | 7/1985 | Finn et al. | 428/222 |
| 4,601,942 | 7/1986 | Finn et al. | 428/229 |

*Primary Examiner*—James J. Bell

*Attorney, Agent, or Firm*—Sughrue, Mion, Zinn, Macpeak, and Seas

[57] ABSTRACT

A papermachine fabric comprises a spiral link belt covered with a sheet of non-woven fabric with the fiber ends being entangled with the elements of the spiral link belt. The non-woven fabric is bonded to the spiral link belt by a multiplicity of fine high pressure fluid jets. In the manufacture of the papermachine fabric the fluid jets are preferably arranged in a predetermined pattern which is produced by interposing a sheet with apertures arranged according to said pattern between the fluid nozzles and the non-woven fabric.

6 Claims, 4 Drawing Figures

PAPERMACHINE FABRIC IN THE FORM OF A SPIRAL LINK BELT COVERED WITH NONWOVEN FABRIC

BACKGROUND OF THE INVENTION

The invention relates to a papermachine fabric in the form of a spiral link belt covered with a non-woven fabric sheet.

Papermachine fabrics in the form of spiral link belts are disclosed in German Offenlegungsschrift No. 2,419,751 and U.S. Pat. No. 4,346,138. Such spiral link belts consist of a multiplicity of meshing synthetic resin helices. The windings of adjacent synthetic resin helices overlap to such an extent that a channel is formed. A pintle wire is inserted into said channel and secures the helices together. Such spiral link belts serve as conveyor and filter belts and recently have replaced the conventional drier felts in the drying section of papermaking machines. The use in paper manufacture has hitherto been confined predominantly to the drying section, because in this section of the papermaking machine the requirements as to marking characteristics, mechanical abrasion, and resistance to compression are minimal. However, it is a disadvantage of the spiral belts that the large voids in the interior of the spiral links carry along a large volume of air and, at high speeds of the papermaking machines, act as blowers. At the deflection points of the belts the entrained air is ejected and may cause the paper sheet to flutter and, at very high speeds, even to tear.

In the modern Uni-Run belt guide systems in which a single belt guides the paper sheet over all the rotary driers of the upper and lower cylinder rows the entrained volumes of air produce superatmospheric pressure in the wedge shaped spaces between the drier cylinder and the arriving belt which at high speed, forces said air through the drier fabric, and the air then blows the paper web from the supporting drier fabric and, in extreme cases, even tears it. For this reason, low air permeability is required for Uni-Run belts.

Attempts have been made to reduce the permeability of the spiral link drier belts. According to U.S. Pat. No. 4,362,776, the voids in the helices are filled with filler material in the form of monofilamentary, multifilamentary, or ribbon-shaped yarn. Similar methods are known from German Offenlegungsschrift No. 3,135,140 and French Patent Publication No. 2,494,318, where a fiber nap can be on the surface of the strips of filler material. According to U.S. Pat. No. 4,381,612, stuffing filaments of thermoplastic material are used which are caused to flow under the influence of heat and to expand and thereby fill the interior of the helices. However, this effects only partial filling of the helix interiors. The higher the degree of filling, the more difficult it is to introduce the filler material. According to this method the air permeability is reduced from a cfm value of 1000–1100 for an unfilled spiral link belt to values of about 150–200 cfm.

German Offenlegungsschrift No. 3,147,115 discloses a papermachine fabric composed of a spiral link belt covered with a sheet of non-woven fabric. The non-woven fabric is fastened to one side of the spiral link belt by means of a binder warp. Such papermachine fabrics are contemplated for use in the sheet forming section of a papermaking machine.

In some types of fine paper the coarse structure of the spiral link belts leaves pronounced marks, particularly if the spiral link belts are used in the first drier groups of the papermaking machine where the paper sheet is still rather moist, and thus soft and sensitive to marking. Therefore, drier fabrics for use in this section are provided with a covering in the form of a non-woven fabric made of fine fibers which is needled onto the finely woven drier fabric on specially designed machines. In this process numerous needles with barb-like ends penetrate the non-woven fabric and the supporting fabric at closely spaced points. The fibers of the non-woven fabric are entrained by the needles and are anchored in the supporting fabric.

Drier fabrics have been partially replaced by spiral link belts, and attempts have also been made to needle a non-woven fabric thereto in order to reduce marking and to obtain a closed, smooth surface which is less prone to carry along air. Due to the relatively large diameter of the synthetic resin wires from which the helices of the spiral link belts are wound, however, the needles damaged said wires. Such damage to the synthetic resin wires not only reduced the strength of the spiral link belt but also had the result that the damaged wires became prone to premature attack by hydrolysis.

The use of fluid jets in the manufacture of non-woven fabrics, per se, is disclosed in U.S. Pat. No. 3,485,706, and is known as the spun-lace technique.

SUMMARY OF THE INVENTION

Therefore the present invention has the object of providing a papermachine fabric comprised of a spiral link belt having a non-woven fabric bonded thereto which is useful particularly in the drying section of a papermaking machine and a method for producing such a papermachine fabric.

The present invention is also directed to the method of bonding a non-woven fabric to a spiral link belt comprising directing a multiplicity of fine, high pressure fluid jets against said non-woven fabric which is superimposed on said spiral link belts so that the fiber ends of the non-woven fabric become entangled with and wrap around the elements of the spiral link belt. The method also involves aligning the jets with the apertures in the spiral link belt by means of an apertured sheet which is advanced synchronously with the spiral belt. Finally the surface of the non-woven fabric is smoothed and closed subsequent to the bonding of the non-woven fabric to the spiral link belt by means of fulling.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
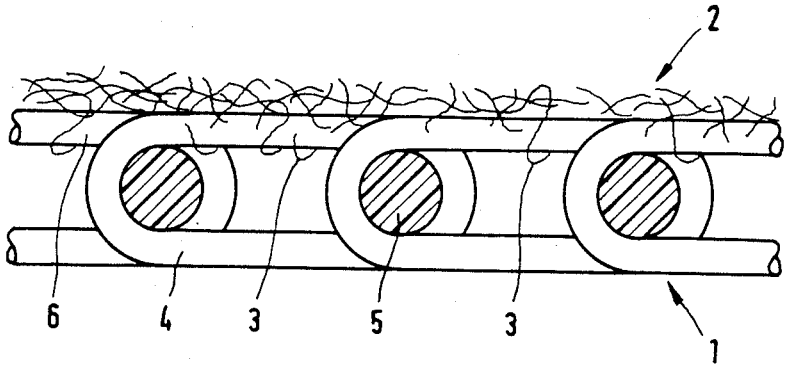
FIG. 1 shows a vertical section through a spiral link belt covered with non-woven fabric.

According to FIG. 1 the papermachine fabric comprises a spiral link belt 1 supporting a covering in the form of a non-woven fabric 2. The spiral link belt 1 consists of a multiplicity of helices 4, and the windings of adjacent helices 4 overlap sufficiently to form a channel through which a pintle wire 5 is inserted. The non-woven fabric 2 supported by the spiral link belt 1 consists of entangled and interlaced fibers. Individual fiber ends 3 are entangled with the elements of the spiral link belt 1, particularly with the helices 4, and are partially wrapped around the latter. This makes a sufficiently strong bond between the non-woven fabric 2 and the spiral link belt 1.

Figure 2:
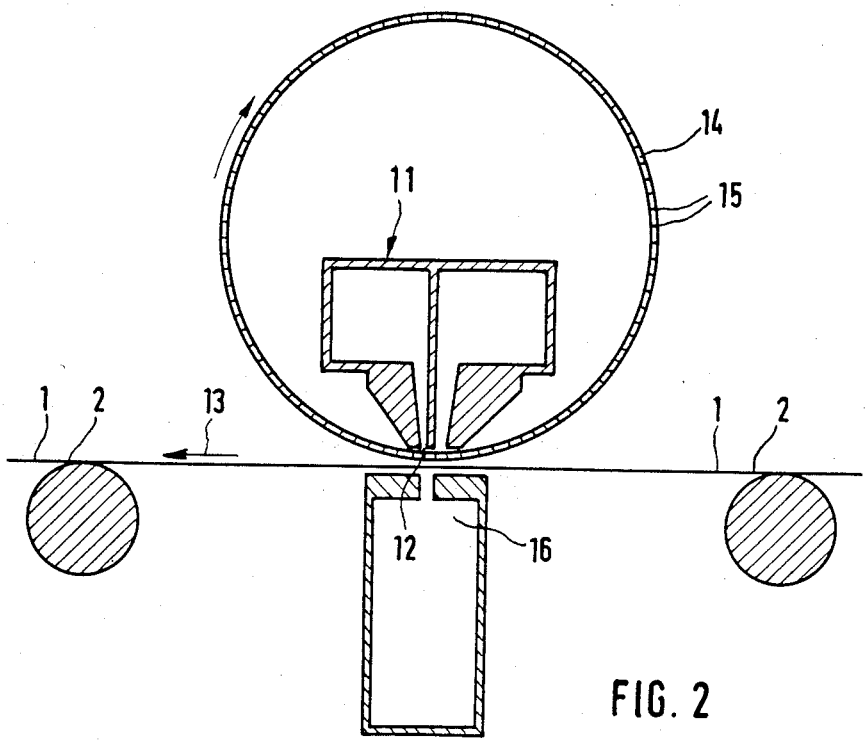
FIG. 2 schematically shows an apparatus for bonding the non-woven fabric to the spiral link belt.

FIG. 2 schematically shows an apparatus for bonding the non-woven fabric 2 to the spiral link belt 1 by fluid jets. In a distributor box 11 water is supplied across the width of the spiral link belt 1 and issues from a nozzle 12 in the form of an extremely thin jet whose width corresponds to the width of the spiral link belt 1 and whose thickness, i.e., the dimension in the direction of advance 13 of the spiral link belt 1, is variable by variation of the distance between the nozzle lips. A rotating cylinder 14 is located between the nozzle 12 of the distributor box 11 and the spiral link belt 1 having the non-woven fabric 2 thereon. The rotating cylinder 14 is provided with closely spaced apertures 15 arranged in a predetermined regular pattern.

By means of projections extending from the rim of the cylinder 14 which engage in the openings in the spiral link belt 1 like a sprocket wheel it is possible to synchronize the advance of the cylinder 14 and the spiral link belt 1 with non-woven fabric 2 thereon at the point of contact to ensure that the openings 15 in the cylinder 14 invariably are aligned with the openings 6 in the spiral link belt. As a result the water jets pierce only the portion of the non-woven fabric 2 overlying the openings in the spiral link belt 1.

Below the spiral link belt 1 there is a receptacle 16 for collecting the water flowing through. The receptacle 16 can be subjected to subatmospheric pressure in order to withdraw substantially all the water from non-woven fabric and the spiral link belt.

The above described apparatus as shown in FIG. 2 is more fully disclosed in PCT Publication No. WO 82/02911.

At the site of impingement of each water jet a portion of the supported non-woven fabric is forced into the interior of the spiral link belt. At these sites depressions or holes are formed in the non-woven fabric 2. By subsequent fulling, the surface of the non-woven fabric is smoothed and closed. By repeated passage of the spiral link belt 1 together with the non-woven fabric covering 2 underneath the nozzle 12 and the cylinder 14 the bond between spiral link belt 1 and non-woven fabric 2 can be strengthened if necessary. Normally each water jet consolidation is followed by fulling.

Since the helices 4 of the spiral link belt 1 consist of monofilament wires, and thus have a smooth surface, it is advantageous to roughen the surface of the spiral link belt by treatment with coarse sand paper. To this end sand paper is helically wound on a roll and rotated so that the spiral link belt is roughened and sanded by engaging the roll wound with sandpaper.

Spiral link belts filled with textured PA (polyamide) filaments are advantageous. The filaments are inserted into the interior of the helix while the latter is being wound. The filling reduces the permeability of the spiral link belt and helps to firmly anchor the fiber ends of the non-woven fabric in the spiral link belt.

When hydraulically bonded belts are used in the press section of a papermaking machine the filler wires have a round or quadrangular cross section and a diameter or height equal to or somewhat greater than the diameter of the pintle wires. Said filler wires are preferably made of polyamide, and so are a portion of the helices which also may consist alternatingly of PES (polyester) and PA.

Figure 4:
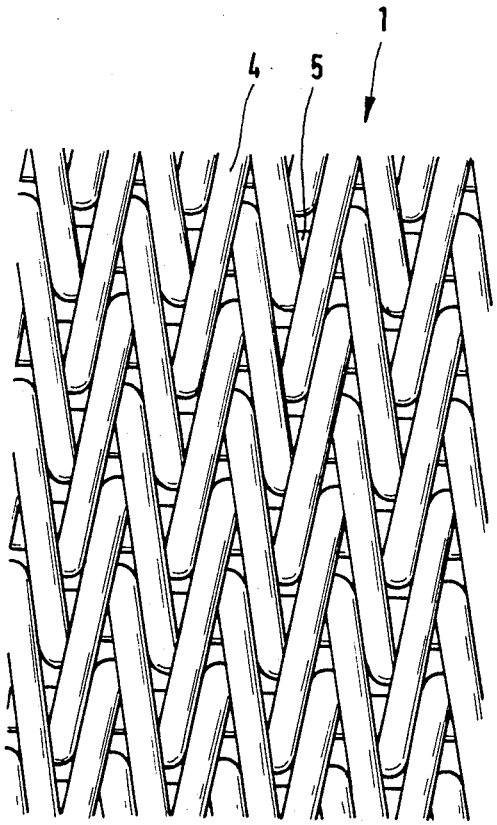
FIG. 4 shows a top view of a wide-spiral belt as in FIG. 3.
Figure 3:
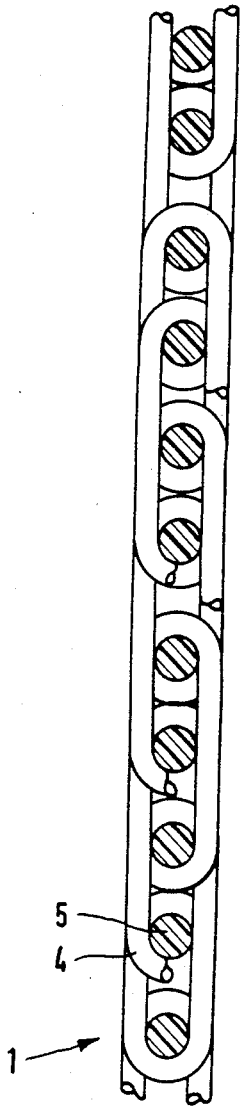
FIG. 3 shows a vertical section through a wide-spiral link belt.

It is also possible to use wide-spiral belts as shown in FIGS. 3 and 4 to which a non-woven fiber fabric has been hydraulically bonded (on only one side of the belt) in the press section. To this end four or five layers of non-woven material of 80 to 120 g/m$^2$ each are applied to the belt (total weight of fabric layer about 380 to 550 g/m$^2$).

Water pressure is especially preferred as the fluid. The water pressure generally ranges between 25 and 140 bar (2500–14000 kPa). In lieu of water other liquids and also gases may be employed, e.g., pressurized air. However, water is preferred because of the higher impact pressure achieved with water.

EXAMPLE 1

The spiral link belt contains PES wire helices; the wire has a diameter of 0.70 mm and is stabilized against hydrolysis. The pitch is 7 windings per centimeter. The pintle wires consist of PES monofilament of 0.90 mm diameter and are likewise stabilized against hydrolysis. They are spaced apart 5 mm. The filling of each helix consists of two textured polyamide filaments of 1300 dtex each. The non-woven fabric on each side is 200 g/m$^2$ thick and consists of a 60:40 mixture of PES and PA fibers.

The air permeability of the spiral belt with filling but without a covering fabric is 470 cfm. The non-woven fabric sheet is preconsolidated by conventional needling. It is continuously laid on the spiral link belt in up to five layers, each attached by water jets. Thereafter the feed of non-woven material is discontinued. The applied non-woven fiber material having a total density of 200 g/m$^2$ is further hydraulically consolidated in four additional passes with fulling taking place after each pass until a smooth surface is obtained.

The water pressure is increased from one pass to the next from initially 40 until finally 75 bar in the last pass. This is accomplished with an apparatus as described in connection with FIG. 2 comprising a perforated cylinder corresponding to the pattern in the surface structure of the spiral link belt. The air permeability of the spiral link belt with the non-woven fabric bonded thereto is 260 cfm.

EXAMPLE 2

A wide-spiral belt composed of left hand and right hand helices is produced in such a way that the length of the helix legs extends over three pintle wires; see FIGS. 3 and 4.

The meshing helices have a wire thickness of 0.60 mm and consist of PES monofilament stabilized against hydrolysis. The pintle wires have a diameter of 0.90 mm. The pitch of the helices is 4.5 windings per centimeter. The density of the pintle wires is 5.5 pintle wires per centimeter and the air permeability is 420 cfm.

The belt has no additional filler wires. A non-woven fabric of 230 g/m$^2$ is applied on one side. The non-woven fabric is a mixture of 35 percent PES and 65 percent PA.

The application is effected in five passes. The non-woven fabric is finally consolidated and fulled in six further passes. The water pressure increases from 40 bar in the first until 120 bar in the last pass.

EXAMPLE 3

A spiral link belt suited for use in the press section is produced according to Example 1 with the following modifications:

The filling of the helices consists of PA-612 monofilament of 0.90 mm diameter. The covering of non-woven fabric is applied in five passes with an application of 100 $g/m^2$ in each revolution so that the entire non-woven fabric covering is 500 $g/m^2$. The water pressure is increased from 45 bar in the first pass up to 130 bar in the last pass.

While the invention has been particularly shown and described with reference to preferred embodiments thereof it will be understood by those in the art that the foregoing and other changes in form and details may be made therein without departing from the spirit and scope of the invention.

What is claimed is:

1. A paper machine fabric comprising a spiral link belt having a plurality of interengaged spiral elements defining upper and lower surfaces and a non-woven fabric superimposed on and bonded to said upper surface of said spiral link belt wherein said non-woven fabric is comprised of a plurality of finite length fibers having ends thereof entangled with and wrapped about said spiral elements.

2. A method for producing a paper machine fabric comprising superimposing a non-woven fabric comprised of a plurality of finite length fibers on a spiral link belt having a plurality of interengaged spiral elements and directing a plurality of fine, high pressure fluid jets against the surface of said non-woven fabric opposite said spiral link belt so that portions of the fibers are entangled with and wrapped about the elements of said spiral link belt.

3. A method as set forth in claim 2 wherein said plurality of fluid jets are formed by interposing a sheet having a plurality of apertures arranged in a predetermined pattern between a thin fluid jet having a width substantially equal to the width of said belt and the non-woven fabric.

4. A method as set forth in claim 3 wherein said spiral link belt is provided with a plurality of openings and further comprising synchronously moving said sheet and said belt having the non-woven fabric thereon to maintain the apertures in said sheet in alignment with the openings in said belt.

5. A method as set forth in claim 3 further comprising fulling the non-woven fabric bonded to said belt to smooth the surface of said non-woven fabric and close openings formed therein by said fluid jets.

6. A method as set forth in claim 5 further comprising subjecting the non-woven fabric bonded to said belt to additional treatments by fluid jets and fulling said non-woven fabric after each treatment.

* * * * *